United States Patent [19]

Benuska

[11] 4,099,682

[45] Jul. 11, 1978

[54] AUTOMATIC WEB WINDER

[75] Inventor: Alfred L. Benuska, Naperville, Ill.

[73] Assignee: V.I.P. Engineered Products Corporation, Elk Grove Village, Ill.

[21] Appl. No.: 777,125

[22] Filed: Mar. 14, 1977

[51] Int. Cl.[2] ..... B65H 19/20; B65H 17/02

[52] U.S. Cl. ..... 242/56 R; 242/67.1 R; 242/74

[58] Field of Search ..... 242/56 R, 67.1 R, 67.2, 242/67.3 R, 74, 74.1, 81

[56] References Cited

U.S. PATENT DOCUMENTS

| | | | |
|---|---|---|---|
| 1,467,841 | 9/1923 | Cumfer | 242/56 R |
| 1,872,018 | 8/1932 | Street | 242/56 R |
| 2,306,466 | 12/1942 | Patterson | 242/81 |
| 3,690,583 | 9/1972 | Herman | 242/81 X |

*Primary Examiner*—Edward J. McCarthy
*Attorney, Agent, or Firm*—Ronald E. Barry

[57] ABSTRACT

An automatic web winder for winding a continuous web into rolls of predetermined length, the winder including a feed assembly, cutting assembly and measuring assembly positioned to feed the web into a mandrel assembly, the mandrel assembly including a mandrel having a feed-through slot for receiving the lead end of the web, an apron assembly for directing the lead end of the web into the slot and a resolver for indicating the angular position of the slot at the end of each cycle, the signal of the resolver being sensed and used to orient the mandrel to a position where the slot is aligned to receive the lead end of the web in the shortest angular motion, and a roll ejector assembly for automatically ejecting the roll from the mandrel at the end of a cycle of operation, the ejector assembly being activated by the movement of a mandrel bearing support assembly which is moved away from one end of the mandrel to release the roll for ejection from the mandrel.

9 Claims, 9 Drawing Figures

AUTOMATIC WEB WINDER

BACKGROUND OF THE INVENTION

Roofing material is normally manufactured in the form of a continuous web which must be cut to predetermined lengths and rolled for transporting and storage. The rolls are formed on a mandrel which is normally manually controlled. This requires the web to be stopped after it has been cut, completely wound on the mandrel and manually ejected onto a pallet. The operator then starts the web through the cutting assembly and repeats the cycle. The speed of the operation is thus dependent upon the dexterity of the operator. It has been determined that one of the slowest steps in the operation of the winder is the time required to align the feed through mandrel in the plane of the web.

SUMMARY OF THE INVENTION

The web winder of the present invention has been automated to operate at speeds which correspond to the speed of the web. This is accomplished by automatically synchronizing the operation of the cutting assembly, feed assembly and mandrel assembly with the measuring assembly so that the winder can operate at the speed of delivery of the web to the winder. The increased speed of operation can be attributed to the ability of the winder to index the feed through mandrel to the plane of the web in the shortest length of angular motion. Once this had been accomplished, the operation of the other winder assemblies was automated and synchronized to the speed of the web.

DRAWINGS

DESCRIPTION OF THE INVENTION

Figure 2:
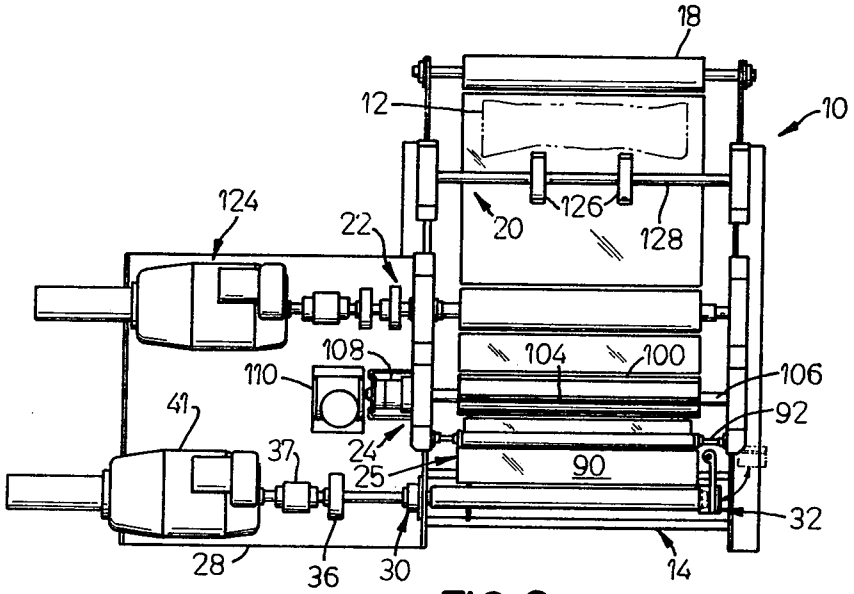
FIG. 2 is a top view of the web winder according to the invention.
Figure 1:
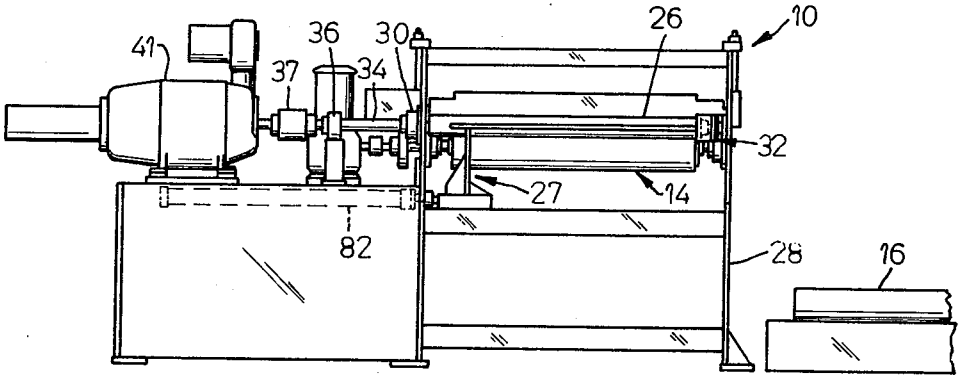
FIG. 1 is an end view of the web winder according to the invention.
Figure 3:
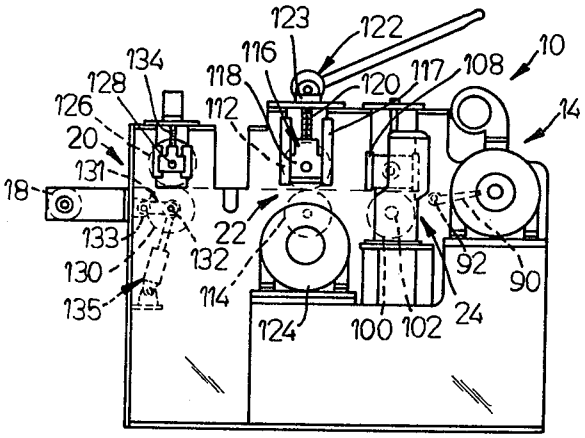
FIG. 3 is a side view of the web winder according to the invention.

In a roofing plant, an asphalt web 12 is formed at a continuous rate of speed and fed to a web winder 10. The web winder 10 is used to roll the web 12 into rolls 16 of predetermined lengths. The web winder 10 according to this invention includes a base or frame 28 having a roll mandrel assembly 14 mounted thereon which is controlled automatically to increase the rate of production of asphalt rolls 16. This is accomplished by rapidly returning the mandrel assembly 14 to a position to receive the lead end of the web 12 and to rapidly eject the rolls 16 from the mandrel assembly 14 so that a practically continuous movement of the web 12 through the web winder is maintained.

Generally, the web winder 10 feeds the asphalt web 12 over an idler roller 18 through a measuring assembly 20, a feed assembly 22, a cutting assembly 24 and an apron assembly 25 into the roll mandrel assembly 14. As the asphalt roll 16 is formed, the web 12 is measured and cut to the predetermined length. The mandrel assembly 14 is rotated continuously until the trailing end 15 of the asphalt web 12 is located in a vertical or hanging position on one side of the roll 16. The roll 16 is then rapidly ejected from the mandrel assembly 14 by means of the ejector assembly 27 onto a pallet where it is stacked for shipment and storage. This cycle is continued as long as the web 12 is fed to the web winder 10.

Figure 4:
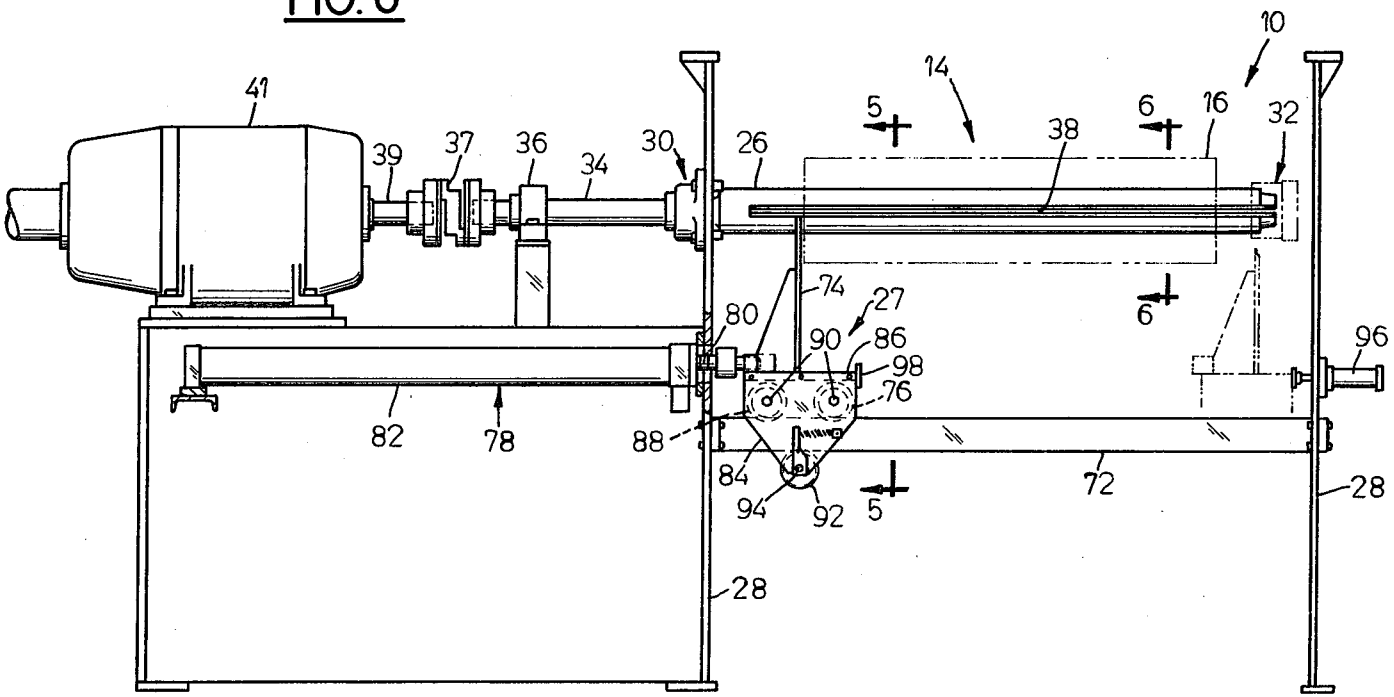
FIG. 4 is an enlarged view of the ejector assembly for the roll mandrel.
Figure 6:
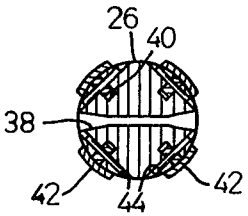
FIG. 6 is a view taken on line 6-6 of FIG. 4 showing the mandrel.

The Roll Mandrel Assembly (FIGS. 4 and 6)

The roll mandrel assembly 14 includes a feed-through mandrel 26 which is supported on the base or frame 28 by means of a fixed bearing assembly 30 and an outboard support bearing assembly 32. The feed-through mandrel 26 includes a shaft 34 which extends through the bearing assembly 30. The shaft 34 is connected by a coupling 37 to the drive shaft 39 of a four quadrant regenerative drive motor 41. The drive motor is thus capable of starting and stopping in forward and reverse.

The mandrel 26 includes a longitudinal slot 38 which tapers outwardly on each side of the mandrel 26. A number of grooves 40 are provided at 90° intervals on the outer surface of the mandrel 26. The asphalt rolls 16 are supported on the mandrel 26 by means of a number of T-shaped members 42, four in number, mounted in the groove 40. The members 42 are retained therein by means of roll pins 44 which are located in cam slots provided in the member 42. The members 42 are cammed radially outwardly with respect to the axis of the mandrel 26 by means of the support bearing assembly 32 in order to support the asphalt roll 16 during winding and to release the roll 16 for ejection from the mandrel 26.

Figure 7:
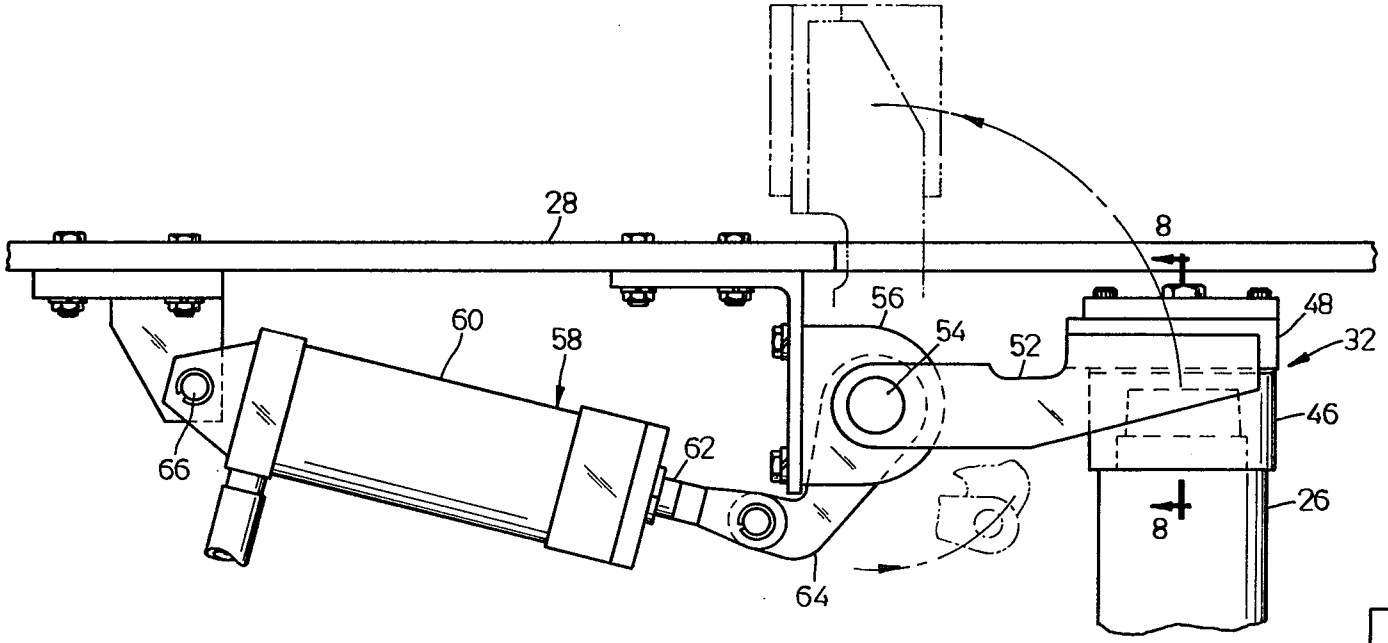
FIG. 7 is a view of the outboard bearing support assembly.
Figure 8:
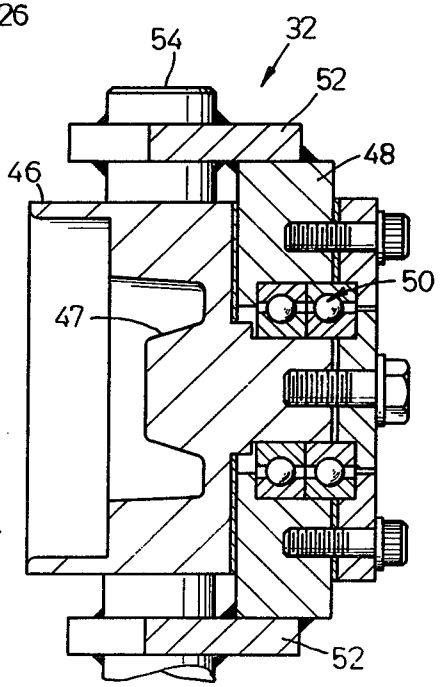
FIG. 8 is an enlarged cross sectional view taken on line 8—8 of FIG. 7.

In this regard, the bearing assembly 32 as seen in FIGS. 7 and 8 includes a mandrel end support member 46 supported on a plate 48 by means of a bearing assembly 50. The plate 48 is supported on a pair of arms 52 which are secured to a pivot shaft 54. The pivot shaft 54 is supported in bearings 56 provided on the frame 28.

The support member 46 includes an axially extending cone 47 which is positioned to engage the end of the T-shaped members 42. On rotation of the mandrel end support member 46 into engagement with the end of the mandrel 26, the cone 47 will cam the T-shaped members 42 radially outwardly to form a support for the web as it is wound on the mandrel. When the mandrel end support member 46 is pivoted away from the end of the mandrel 26, the members 42 will be free to move radially inwardly to release the roll for ejection from the web winder 10.

The pivot shaft 54 is rotated to move the mandrel end support member 46 toward and away from the end of the mandrel 26 by means of a pneumatic piston and cylinder assembly 58. The assembly 58 includes a cylinder 60 and a piston rod 62 which is connected to a linkage arm 64 provided on the pivot shaft 54. The cylinder 60 is pivotally mounted on the frame 28 by a pivot pin 66.

Figure 9:
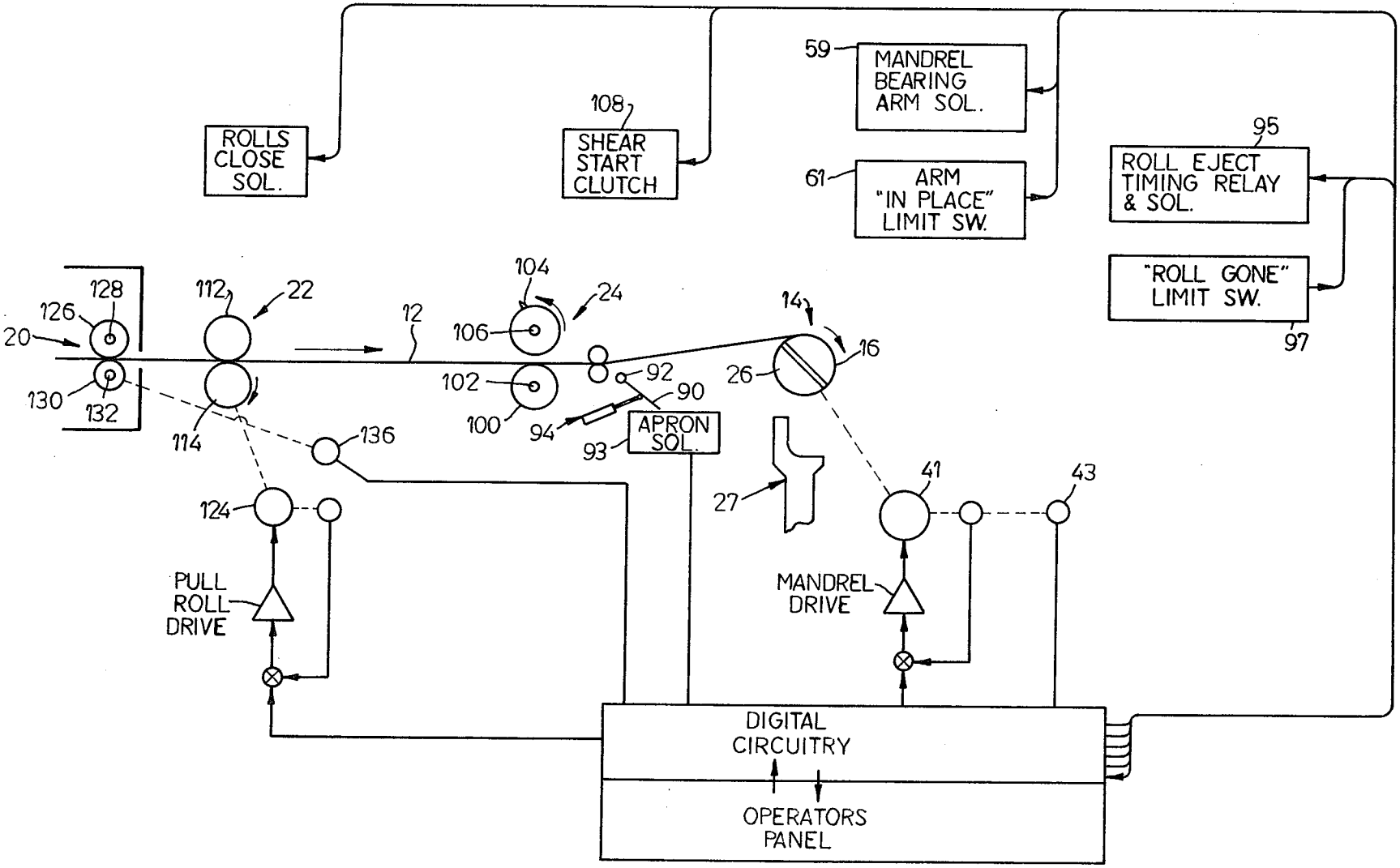
FIG. 9 is a schematic block diagram of the digital control circuit for the web winder according to the invention.

The piston and cylinder assembly 58 is controlled by means of a bearing arm solenoid 59 shown schematically in FIG. 9. The solenoid is energized when the roll has been wound on the mandrel to release the roll for ejection from the mandrel. An arm-in-place limit switch 61 is provided on the base to indicate when the mandrel is ready to begin the next cycle.

Mandrel Orient

The feed-through mandrel 26 is oriented at the start of each cycle to align the longitudinal slot 38 in a position to receive the web. Mandrel orient is achieved by means of a sine-cosine resolver 43 (shown schematically in FIG. 9) which is directly connected to the drive shaft 39 of the drive motor 41. The resolver 43 provides a signal to the digital control system as described hereinafter indicating the exact angular position of the slot 38. This signal is sensed in the control system and automatically rotates the drive motor 41 to align the slot 38 with the web in the shortest distance of angular motion.

Figure 5:
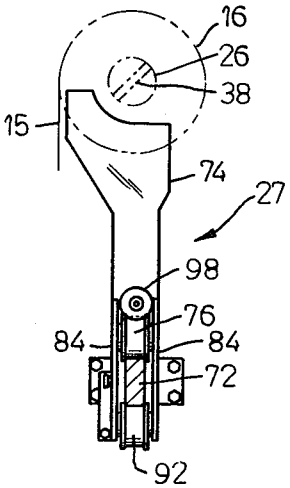
FIG. 5 is an end view taken on line 5-5 of FIG. 4 of the ejector assembly.

Ejector Assembly (FIGS. 4 and 5)

The roofing rolls 16 are ejected from the mandrel 26 by means of the ejector assembly 27. The ejector assembly 27 includes a support beam 72 located on the base 28 below the mandrel assembly 14. The rolls 16 are ejected by a pusher plate 74 supported for longitudinal movement on the support beam 72 by means of a carriage 76. The carriage 76 is moved longitudinally by means of a pneumatic piston and cylinder assembly 78 mounted on the base 28. The piston rod 80 of the piston and cylinder assembly 78 is connected to the carriage 76 and is supported in the cylinder 82 for longitudinal movement with respect to the beam 72.

More particularly, the carriage 76 includes a pair of mounting plates 84 supported in a parallel spaced relation by a top plate 86. A pair of rollers 88 are pivotally mounted on pivot shafts 90 in a position to ride on the top of the beam or track 72 and a lower roller 92 is pivotally mounted on a shaft 94 in a position to roll along the bottom of the beam or track 72.

In operation, the carriage 76 is moved along the length of the beam 72 at an accelerating rate by the actuation of a pneumatic cylinder in order to throw the roll 16 clear of the mandrel 26. The carriage 76 is stopped by reversing the motion of the pneumatic cylinder. Means are provided on the opposite side of the base 28 in the form of a shock absorber 96 to stop the carriage 76 if it travels to the end of the stroke. A bumper disc 98 is provided on the front of the carriage 76 in a position to engage the shock absorber 96.

The ejector assembly is activated when the bearing arm support assembly 27 clears the end of the mandrel 26. A timing relay and solenoid 95 (shown in FIG. 9) is used to control the ejector assembly. A "roll gone" limit switch 97 is provided at the end of beam 72 which is connected to the bearing arm solenoid 59 to return the bearing arm to the mandrel.

Cutting Assembly (FIG. 7)

The web 12 is cut by means of the cutting assembly 24 which is located in a spaced relation to the mandrel assembly 14. The cutting assembly 24 includes an anvil roll 100 which is pivotally mounted on a shaft 102 and is free to roll continuously with the web 12 as it is fed to the mandrel assembly 14. The web 12 is cut by means of a knife 104 which is mounted on a shaft 106. The shaft 106 is rotated by means of a one revolution clutch 108 that is driven by means of an AC gear motor 110. The gear motor 110 rotates continuously to drive the anvil roller 100 and on actuation of the one revolution clutch 108 the knife 104 will rotate through 360°. The knife will rotate into engagement with the anvil roller 100 to cut the web 12 as it passes through the cutting assembly 24.

When the web 12 is cut, the feed roll assembly 22 will stop momentarily allowing the trailing end 15 of the web to be wound into the mandrel assembly 14. When the feed roll assembly is again started, the lead end of the web 12 is guided into the slot 38 in the cylindrical section 36 by means of the apron assembly 25 located between the cutting assembly 24 and the mandrel assembly 14.

Apron Assembly 25

The apron assembly 25 includes a plate 90 mounted on a shaft 92. The shaft is mounted for rotation in the base 28. The apron plate 90 is moved to a support position by means of a double-acting pneumatic piston and cylinder assembly 94. An apron solenoid 93 is used to control the assembly 94.

Feed Assembly 22

The web 12 is fed to the cutting assembly 24 by means of the feed assembly 22 which is located in a spaced relation to the cutting assembly 24. The feed assembly 22 includes a top pull roll 112 and a bottom pull roll 114. The top pull roll 112 is supported for vertical movement with respect to the bottom pull roll 114 by means of take-up bearing assemblies 116. In this regard, the take-up bearing assemblies 116 include shaft bearings 118 mounted in guide bars 117. The bearings 118 are biased by means of spring 120 downward to force the top roll 112 against the bottom roll 114. The top roll 112 is raised vertically upward with respect to the bottom roll 114 by means of an eccentric cam assembly 122 to provide clearance for feeding the web 12 through the feed assembly. The eccentric cam assembly 122 is connected to the bearing assemblies 116 by rods 123. The feed assembly 22 is driven by means of a DC four quadrant regenerative drive motor 124 connected to the bottom pull roll 114.

Measuring Assembly

The length of web being fed to the mandrel assembly 14 is measured by means of the measuring assembly 20 which is located in a spaced relation to the feed assembly 22. The measuring assembly 20 is conventional and includes a pair of wheels 126 mounted on shafts 128 and a pair of wheels 130 mounted on a shaft 132. The shaft 128 for the upper wheels 126 is journalled in brackets 127. The shaft 132 for the lower wheels 130 is journalled in a pair of links 131 which are pivotally mounted in brackets 133. The wheels 130 are pivoted toward and away from the upper wheels 126 by means of a pneumatic piston and cylinder assembly 135. Sufficient pressure is provided by the assembly 135 to assure that the wheels roll with the web. The rotary motion of the wheels 126 is recorded by a resolver or counter mounted on the end of shaft 128 which indicates the number of revolutions and the length of web being fed to the mandrel. After the preset length of web has been registered by the counter 136, the drive motor for the pull rolls is stopped.

The Control System

The control system for the web winder 10 according to the invention is made up of conventional devices which are used to control the various assemblies of the winder. These devices are not shown but include the following.

A thread speed potentiometer connected to the drive motor 124 for the pull rolls 112 and 114 to control the maximum speed of the pull rolls while the web 12 is being fed into the mandrel assembly 14. This potentiometer is activated at the start of each cycle of operation and allows for a maximum speed of the web 12 through the pull rolls of 400 feet per minute. A thread prove network is provided between the pull roll drive motor and the mandrel drive motor. This network is connected to compare the tachometer feedback signals from the two motors. If the mandrel motor accelerates to a speed that is 25 to 30% faster than the pull roll drivemotor, the winder will automatically shut down. It should be noted that the mandrel speed is dependent on the tension of the web and if the web is not threaded, the mandrel will accelerate rapidly. This will also happen if the web should break.

A running speed potentiometer is connected to the drive motor 124 to control the speed of the pull rolls 112 and 114 during operation and can be set to feed the web at speeds from 400 to 1500 feet per minute.

A roll flap orient potentiometer is connected to the motor 41 to control the speed of the mandrel 26 after the web 12 has been sheared. The mandrel 26 will accelerate to the maximum speed set on the potentiometer and as soon as the web 12 reaches the set speed, the motor will start to decelerate until it stops in position for ejection of the roll from the mandrel. The preset acceleration and deceleration rates of the mandrel 26 determine the position and length of the free end 15 of the web 12 on the roll 16 when the mandrel stops.

A web tension potentiometer is connected to the motor 41 to control the tension of the web 12 being wound on the mandrel 26 by adjusting the mandrel motor voltage during the high speed operation of the winder.

A bearing arm timer, i.e. potentiometer is used to control the time delay between the time when the mandrel outer bearing assembly 32 pivots the mandrel end support member out of position and the time that the solenoid 95 for the ejector assembly 27 is actuated to start the roll eject cycle.

A flap speed potentiometer is connected to the mandrel drive motor 41 to control the peak velocity of the mandrel 26 during the flap orient cycle.

A pull roll shear speed potentiometer is used to control the speed of the pull roll drive motor 124 during the shear cycle. The pull rolls 112 and 114 are decelerated from winding speed to shear speed prior to actuation of the web cutting assembly 24.

A pull roll acceleration potentiometer is used to control the rate of acceleration of the pull roll drive motor 124 to threading speed and then to running speed during the winding operation.

A pull roll deceleration potentiometer is used to control the deceleration rate of the pull rolls drive motor 124 from running speed to shearing speed to zero speed. It should be noted that after the web has been sheared, the pull roll motor 124 is stopped to allow the roll 16 to be ejected from the mandrel. Although other control devices are provided in the control system such as start up and stop buttons for manually actuated controls, they are not considered a part of the present invention and are not described herein.

As noted in FIG. 9, a digital control circuit is used to synchronize the operation of various control devices for the web winder 10.

Sequence of Operation

In operation, the web winder 10 is threaded with the web 12 as follows.

The lower measuring wheels 130 are lowered and the upper pull roll 112 is raised. The web 12 is manually fed through the measuring assembly 20 and the feed assembly 22. The pull roll 112 is lowered and the measuring wheels 130 are raised to engage the web 12.

In order to properly locate the position the lead end of the web 12, the pull rolls are driven far enough to move the web through the cutting assembly 24. The cutting assembly 24 is then manually actuated to cut the end of the web. On automatic operation, the measuring assembly is synchronized with the cutting assembly so that the cutting assembly is automatically actuated. Whenever the measuring assembly indicates that the preset length of the web has passed through the measuring assembly, the cutting assembly will be actuated to cut the web.

Before starting the operation of the web winder, the length of web should be set to the desired length of the roll to be wound. Web tension, thread speed and running speed should be set to the desired speed.

On initiation of the cycle of operation, the following four functions will be performed instantly:

(1) The mandrel outboard bearing control valve solenoid 59 is energized to position the outboard bearing support in the end of the mandrel 26 for winding. (If not properly seated, the system will not operate).

(2) The mandrel drive motor 41 will rotate the mandrel 26 to thread orient position. This is an automatic movement which rotates the mandrel in either direction, whichever is shorter, to index the mandrel slot 34 for threading.

(3) The threading apron solenoid valve 93 is energized to raise the apron plate 90 to threading position.

(4) The feed rolls 112, 114 are accelerated to thread speed to feed the web into the mandrel 26.

As the web is fed into the slot in the mandrel, the pulse generator or resolver 136 sends pulses to the control circuit. When the control circuit receives a pulse count equivalent to the length of web required to enter and pass through the mandrel slot 38, the following two functions will then be performed: the spring control valve 93 will be de-energized to lower the apron plate 90, and at the same time, the mandrel drive motor 41 will accelerate the mandrel 26 to increase the tension on the web from 0 to 4 pounds per inch of web width. The tension is measured from the core diameter and decreases as the roll diameter increases.

After the mandrel 26 has completed two to three revolutions, the thread prove network will check the rpm's of the mandrel 26 to determine if the mandrel 26 has been successfully threaded. If threaded, the mandrel 26 will accelerate to high wind speed. The mandrel will continue to run at high wind speed until the control circuit has received a total number of pulses from the pulse generator 136 on the measuring assembly which indicates that a preset length of web has passed as set on the feed length switch. When the setting has been equaled, the machine will decelerate to cutting speed and will continue to run until the cutting assembly 24 is energized to rotate the knife through one revolution to cut the web.

At the instant the web has been cut, the feed assembly 22 will stop and the mandrel 26 will switch from a torque control mode to a speed regulated condition which will allow the mandrel drive motor 41 to continue to run a sufficient length of time after the cut signal to orient the roll flap 15 or trailing end of the web. When the trailing end 15 of the web has been stopped in the required position, the outboard support bearing assembly 32 will be energized to move away from the end of the mandrel 26 and the ejector assembly 27 will be energized to eject the roll 16 from the mandrel. When the ejector carriage reaches the end of its travel, the carriage will be reversed and the next winding cycle will commence when the outboard bearing is returned.

At the start of each cycle, three functions are performed. The pull rolls 112, 114 are rotated to start feeding the web to the mandrel assembly, the apron assembly 25 is energized to move up into alignment with the slot 38 in the mandrel and the mandrel 26 is oriented to bring the slot 38 into alignment with the apron plate 90. As the web 12 approaches the mandrel, the apron plate 90 will guide it into the slot 38. The distance the web has to move is premeasured so that the mandrel will start to rotate as soon as the web has been moved far enough to enter the slot 38 in the mandrel. When the mandrel starts to rotate, the apron plate 90 is dropped and the preset length of web 12 is then wound on the mandrel.

The embodiments of the invention in which an exclusive property or privilege is claimed are defined as follows:

1. In a web winder having a base, a measuring assembly, a feed assembly and a cutting assembly mounted on said base in a series relation, and a control system for synchronizing the operation of the measuring, feed and cutting assemblies, the improvement comprising:

a web roll mandrel assembly mounted on the base in a position to receive the lead end of the web, said assembly including a slotted mandrel, means for driving said mandrel to wind the web into a roll of predetermined length, said driving means being rotatable in either direction, and means connected to said drive motor for providing a signal to the control system indicating the rotary position of the slot in said mandrel whereby said mandrel can be automatically rotated in either direction to orient the slot in the mandrel to receive the lead end of the web in the shortest angular motion.

2. The web winder according to claim 1 including means mounted on said base for ejecting the web roll wound on the mandrel from the web winder.

3. The web winder according to claim 1 including an apron means mounted on said base beneath said web, said apron means being movable from an inoperative position to an operative position in line with the slot in said mandrel and means for moving said apron means to the operative position on ejection of a roll from said mandrel to guide the lead end of the web into the slot of the mandrel.

4. An automatic web winder comprising:

a base, a roll mandrel assembly mounted on said base, said assembly including:

a feed-through mandrel having a slot for receiving the lead end of the web, a drive motor connected to said mandrel for rotating said mandrel in either direction, and indicating means connected to said mandrel for providing a signal indicating the rotary position of the slot in said mandrel, a web feed assembly mounted on said base in a position to feed an asphalt web to the roll mandrel assembly, a web cutting assembly mounted on the base in a position to cut the web, and a control system operatively connected to the feed assembly and web cutting assembly, said control assembly responding to the signal from the indicating means to rotate the slot in the mandrel in the shortest angular direction to receive the lead end of the web at the start of each cycle of operation.

5. The web winder according to claim 4 including an apron assembly mounted on said base for movement to a position to feed the lead end of the web into the feed through mandrel and means for actuating said apron assembly to the feed position at the start of each cycle of operation.

6. The winder according to claim 4 including means for ejecting rolls wound on said mandrel from the web winder at the end of each cycle of operation.

7. An automatic web roll winder comprising:

a base, a roll mandrel assembly mounted for rotary motion on said base, said assembly including a mandrel having a slot therein, drive means for rotating said mandrel in either direction, means connected to said drive means for indicating the angular position of the slot in the mandrel, control means connected to respond to said indicating means to rotate said drive means and said mandrel to position the slot to receive the web, a feed assembly for feeding a web to said mandrel, apron means moveable to a position to guide the lead end of said web into the slot in said mandrel and means for ejecting the web roll wound on said mandrel from said winder.

8. The web winder according to claim 7 wherein said mandrel includes bearing means supporting one end of said mandrel, said bearing means being moveable from said one end of said mandrel to allow for ejection of the roll from the mandrel.

9. The web winder according to claim 8 including a measuring assembly for measuring the length of web fed to the mandrel and a cutting assembly for cutting the web in predetermined lengths.

* * * * *